US007152520B2

(12) United States Patent
Kerner

(10) Patent No.: US 7,152,520 B2
(45) Date of Patent: Dec. 26, 2006

(54) METHOD AND APPARATUS FOR COLLECTING LIQUID AND EXTRACTING TEA ESSENCE FROM A TEA BAG

(75) Inventor: James M. Kerner, Chico, CA (US)

(73) Assignee: United States Thermoelectric Consortium, Chico, CA (US)

( * ) Notice: Subject to any disclaimer, the term of this patent is extended or adjusted under 35 U.S.C. 154(b) by 0 days.

(21) Appl. No.: 10/943,789

(22) Filed: Sep. 17, 2004

(65) Prior Publication Data

US 2005/0120884 A1 Jun. 9, 2005

Related U.S. Application Data

(63) Continuation-in-part of application No. PCT/US2004/005527, filed on Feb. 25, 2004.

(60) Provisional application No. 60/527,111, filed on Dec. 3, 2003.

(51) Int. Cl.
*A47J 19/02* (2006.01)
*A23N 1/00* (2006.01)
*B30B 9/02* (2006.01)

(52) U.S. Cl. ..... 99/323; 99/495; 426/80; 100/135; 210/248

(58) Field of Classification Search ..... 100/135, 100/113, 116, 213, 266, 133, 211, 245, 134, 100/131; 99/323, 495, 279, 496; 210/248; 426/80, 82, 77
See application file for complete search history.

(56) References Cited

U.S. PATENT DOCUMENTS

| | | | | |
|---|---|---|---|---|
| 555,736 A | | 3/1896 | Pritchard | |
| 913,055 A | | 2/1909 | Rollins | |
| 1,163,506 A | * | 12/1915 | Carroll | 108/30 |
| 1,163,507 A | | 12/1915 | Carroll | |
| 1,542,322 A | | 6/1925 | Rollman | |
| 1,762,558 A | * | 6/1930 | Mitchell | 206/464 |
| 1,858,435 A | * | 5/1932 | Conlon | 100/211 |
| 2,478,374 A | * | 9/1949 | Danielson | 210/247 |
| 4,348,950 A | | 9/1982 | Harris | |
| 4,530,277 A | * | 7/1985 | Matsumoto | 99/506 |
| 4,688,479 A | * | 8/1987 | Cunningham | 100/133 |
| 5,461,969 A | * | 10/1995 | Cretsinger | 99/506 |
| 6,672,204 B1 | * | 1/2004 | Fiorello | 99/495 |

FOREIGN PATENT DOCUMENTS

JP 1-223906 7/1989

* cited by examiner

*Primary Examiner*—Reginald L. Alexander
(74) *Attorney, Agent, or Firm*—The Webostad Firm

(57) ABSTRACT

A tea bag press and container assembly configured for receiving a tea bag during or after brewing, which conceals the wet tea bag, collects dripping liquid, and extracts tea liquid essence by efficiently compressing the wet tea bag vertically or sidewardly. In a vertical compression embodiment, a lid has an integral press element that compresses the tea bag against a tea bag support means in the bottom of the container upon applying pressure to the lid. In a sideward compression embodiment, a flexible container retains the tea bag during sideward compression, such as between the thumb and fingers, for releasing tea liquid from the bag. The tea bag press-container assembly is designed to reduce staining and mess on saucers, tables and fabric caused by a dripping tea bag and provides efficient extraction and pouring of tea liquid into an existing beverage, or the brewing of an additional beverage.

16 Claims, 11 Drawing Sheets

METHOD AND APPARATUS FOR COLLECTING LIQUID AND EXTRACTING TEA ESSENCE FROM A TEA BAG

CROSS-REFERENCE TO RELATED APPLICATIONS

This application claims priority from, and is a 35 U.S.C. § 111(a) continuation in part of, co-pending PCT international application Ser. No. PCT/US2004/005527 filed on Feb. 25, 2004 which designates the U.S. and which is incorporated herein by reference in its entirety.

This application claims priority from U.S. provisional application Ser. No. 60/527,111 filed on Dec. 3, 2003, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention pertains generally to a tea bag press and container, and more particularly to a container to extract and collect the liquid essence from a wet tea bag.

2. Description of Related Art

The use of tea as a beverage is said to have been discovered in China around 2737 B.C. At that time, and for centuries thereafter, tea was brewed by pouring boiling water over loose tea. "Tea bags" were then invented in the United States in 1904, and since that time have been widely accepted for their enhanced preparation simplicity when compared with loose teas.

In producing tea bags, shredded and crushed tea leaves are dried, sorted and packed in a small envelope called a "tea bag". To brew a cup of tea, the tea bag is traditionally placed in a container such as a tea cup, mug, or pot to which boiling water is applied, wherein after a period of "steeping" for one to about two minutes the tea beverage is ready for consumption. Steeping a tea bag for extended periods results in brewing a bitter tasting tea as the tannins begin to be extracted from the tea leaves. Therefore, it is preferred that the tea bag should be removed from the container if a bitter tasting brew is to be avoided. A string terminating in a label is typically affixed to the tea bag to facilitate removal from a brewing vessel, as well as for identification and marketing. Removal of a tea bag without a string usually requires the use of a utensil to dip into the tea to remove the bag from the brewing vessel.

As a consequence of the staining properties and the messy nature of a wet tea bag, a tea bag is often left in the tea cup rather than transferring it to another container, in spite of the bitter nature of the over-brewed tea. The containment of a wet tea bag presents a challenge to avoid dripping and a resulting puddle of tea liquid in a saucer, cup, dish or other container, along with associated tea stains. As a result, the typical tea brewing process is both unsightly and messy.

A common practice is to set a tea bag near the rim of the tea cup saucer to prevent transfer of dripping tea across a table or tray. In this case, the tea liquid will continue to seep from the bag and generally run to the center of the saucer where it forms a puddle. The surface tension of the tea will cause it to adhere to the bottom surface of the tea cup, wherein upon lifting the tea cup, the liquid on the bottom of the tea cup can readily drip on a table, linens, clothing, or other surfaces resulting in wetness and staining. In view of the above it will be generally appreciated that removing the tea bag from the cup typically constitutes a messy procedure.

Similarly, when a tea bag is contained in a saucer or other container, it "sits" in the tea drippings from the bag. Upon being picked up to brew a second or third cup of tea, or to dispose of the tea bag, it drips on the table, linens or anything which is under the dripping bag as it is moved.

In attempts to alleviate this messy situation, one practice is to place the tea bag on a spoon, wrap the string around the bag and spoon, and squeeze the remaining liquid by pulling the string, typically aided by the hands, to drain excess liquid tea essence into the cup. Some tea residues typically get on the hands in this process which can also be scalded with a hot tea bag, and the tea bag may even become airborne in response to incorrect or unstable pressure application from the string. Even this protracted process leaves a soggy tea bag on a spoon that needs to be placed on a dish or saucer to stop it from dripping on a table or tablecloth. The string can also tear the tea bag during the squeezing process creating a further mess. Tongs have also been utilized, in particular on stringless tea bags, to retrieve the tea bag and squeeze the remaining liquid, however, it will be appreciated that this process still results in leaving a soggy, unsightly, tea bag on the saucer.

Tea drinkers often prefer extracting additional liquid tea essence from a tea bag by squeezing it after it has been brewed. This liquid tea essence can be utilized to fortify the current beverage or brew additional beverage. Extracting the tea essence into a cup or mug can be a messy process with a spoon, tong or kitchen utensil. Furthermore, tea drinkers would often prefer to preserve the brewed tea bag in a moist state, with sufficient excess liquid removed to prevent leakage (or spoilage if the tea bag is to be saved for a longer period of time), until a subsequent cup of beverage is desired, wherein the tea bag is immersed in additional hot water to brew more beverage and then squeezed to extract remnant liquid tea essence.

A number of drawbacks exist with the removal, storage and reuse of a wet tea bag which have not been fully appreciated in the art, some of which have been described above. A solution to these drawbacks would preferably address transfer of the tea bag before over-brewing, drip-free removal, concealment of a used bag on the table top, and repetitive tea bag brewing for hot or cold beverages.

Therefore, a need exists for a combination tea bag press and container that will receive and conceal a wet tea bag and collect any liquid from the tea bag without dripping or tearing. Further, a container is needed that will hold a wet tea bag in a moist state and allow the drinker to extract tea essence to fortify a tea beverage or brew additional tea beverage. The present invention satisfies those needs, as well as others, and overcomes the deficiencies of previously developed tea handling apparatus and methods.

BRIEF SUMMARY OF THE INVENTION

The present invention is a tea bag press and container apparatus that provides efficient transfer of the tea bag before over-brewing, removal without dripping, concealment of a used bag on the table top, and a capability for multiple brewing with a tea bag. The invention includes a method to squeeze or press the liquid out of the tea bag so that when it is reused it does not drip at all. With respect to the present invention, the term "tea bag press and container", or simply "tea bag press" or "tea bag container" refer to the recited tea bag container having the inventive aspects described herein. It should be appreciated that the present invention encompasses described aspects utilized separately or in combinations, and furthermore the invention encompasses the described aspects utilized in combination with aspects known in the art.

One exemplary embodiment consists of a tea bag press and container assembly that can receive a wet tea bag after the tea is brewed. The press-container assembly has a lid with an integral press. The base of the container preferably has a means for supporting the tea bag while draining off tea essence. For example, a raised support which may comprise raised protrusions or a raised perforated platform can be used to maintain the tea bag above the bottom of the container while allowing liquid from the tea bag to drain into a reservoir at the bottom of the container. The container can be configured for draining the tea bag in response to gravity, or more preferably in response to compression of the tea bag, such as vertical or sideward compression. For example, in the case of vertical compression, the tea bag can be compressed between the raised support and the base of a press element. The press element preferably comprises a protruding portion of the container lid which extends down to compress the wet tea bag retained on the support means. When the tea bag is compressed, the majority of the liquid is captured in the reservoir below the tea bag. As this liquid may contain significant essence of tea, it can be poured out of the spout, such as back into the cup containing boiling water to increase the strength of the hot tea.

When utilizing tea bags without a string, a dry tea bag can be placed in the tea bag container and a small amount of boiling water poured into the container to brew the tea. The resultant brewed tea concentrate may be poured into a teacup with additional boiling water as desired. The wet tea bag can be re-brewed with this process and additional tea essence extracted by compressing the wet tea bag as desired. It should also be appreciated that the brewing of cold tea can be facilitated with this method, because only a small amount of hot water is utilized for generating the tea essence which is then poured into cold, or iced water.

Another exemplary embodiment of the invention is a flexible two-compartment tea bag press and container in which the wet tea bag is retained in the inner compartment. The application of pressure on two exterior sides of the outer compartment, such as with the thumb and fingers, squeezes the inner compartment and thus compresses the tea bag. The inner compartment is configured with a means for draining, such as drain holes, that allow the liquid from the tea bag to drain into a reservoir within the outer compartment, or between compartments (interstitial space), from which it can be poured into a teacup leaving the tea bag in the inner compartment free of excess liquid and ready for dripless reuse or disposal.

Therefore, one aspect of the present invention may be generally described as an apparatus for collecting liquid from a wet tea bag, comprising: (a) a container having an opening on top for receiving a tea bag, wherein the container has generally vertical walls terminating in a rim, and a bottom; and(b) means for supporting a wet tea bag above the bottom of the container. wherein the means for supporting is configured to allow liquid from a wet tea bag positioned on the means to flow into the bottom of the container.

The tea bag container and press may additionally or alternatively incorporate other elements, the following of which given by way of example. A notch may be formed in an upper portion of the container for receiving a string extending from a tea bag. A preferred shape for the container is in a generally rectangular shape. A pouring spout is preferably positioned on the side of the container, such as terminating at the top rim of the container. The spout provides a path through which liquids may be displaced from the container in response to tilting of the container. Preferably, a lid is adapted for covering the entire top opening, or a majority of said top opening, within the container. One method of retaining the lid on the container is with a lid skirt which extends generally downward to fit over the exterior of the container rim when the lid is positioned on the container rim. A handle is preferably joined to the lid to facilitate manipulation of lid position. The lid may operate in concert with the spout for directing liquids to the spout, such as preventing liquids from dripping through the top of the container.

The container is preferably configured with at least one means for compressing a tea bag positioned on the supporting means (i.e. near bottom of the container) toward increasing the amount of liquid drained from the tea bag to the bottom of the container. By way of example, two general approaches of compressing the tea bag are employed: (1) pressing the tea bag from above (vertical compression) against the support means, such as by a protruding extension of the lid which fits the interior of the container; and (2) pressing the tea bag from flexible container sides (sideward compression), wherein an inner porous container retains the tea bag while allowing liquid to drain into the outer container.

Another aspect of the present invention may be described as a method for extracting tea liquid from a wet tea bag, with separate steps for both a downward press, and a sideward press. For a downward press, the method generally comprises: (a) providing a container for receiving and compressing a tea bag, the container comprising a container bottom, a plurality of substantially vertical container walls, a lid, wherein the lid is preferably configured having a downward protrusion (alternatively a separate press element may be utilized), and a tea bag support is coupled to the container bottom allowing liquid to drain from the tea bag into the bottom of the container; (b) placing a wet tea bag on the support in the container; (c) compressing the wet tea bag between the support and the lid protrusion (or press), in response to which tea liquid flows from the compressed tea bag to the bottom of the container; and (d) pouring the tea liquid from the container.

For a sideward press, the method generally comprises: (a) providing a flexible container for receiving and compressing a tea bag, wherein the flexible container has an inner container and an outer container, and wherein the outer container is fluidly connected to the inner container; (b) placing a wet tea bag in the inner container; (c) compressing the outer container thereby compressing the inner container thereby compressing the wet tea bag wherein, in response to the compression, tea liquid flows from the compressed tea bag, and through the porosity of the inner container, such as through apertures in the lower portions, into the outer container; and (d) pouring the tea liquid from the outer container.

The present invention provides a number of advantages, including the following which are included by way of example.

An aspect of the invention is a tea bag press and container with walls, a bottom and a support in the bottom for holding a wet tea bag wherein fluid from the tea bag flows to the container bottom.

Another aspect of the invention are container walls configured to form a container rim which may be in the form of a geometric shape such as a rectangle.

Another aspect of the invention is a spout positioned on the side of the container, such as proximal to the rim, wherein fluid in the container bottom can be poured through the spout by tilting the container.

Another aspect of the invention is at least one notch positioned in the container rim to receive a string attached to a tea bag.

Another aspect of the invention is a lid adapted to substantially conform to the container rim.

Another aspect of the invention is a lid skirt coupled to the lid that extends generally downward and fits outside the container rim.

Another aspect of the invention is the inclusion of a handle on the lid of the tea bag container.

Another aspect of the invention is a lid that is adapted to accommodate a spout in the container rim wherein fluid on the container bottom can be poured through the spout by tilting the container without removing the lid.

Another aspect of the invention is a container lid that is configured with a means for compressing a tea bag when it is positioned on the tea bag support.

Another aspect of the invention is a protrusion extending downward from the lid for compressing a tea bag.

Another aspect of the invention is a press element coupled to the lid and adapted to compress the tea bag resting on the support when the lid is pressed downward.

Another aspect of the invention is a raised support extending upwardly from the container bottom, which maintains a wet tea bag above the bottom of the container while allowing tea essence to drain into the bottom of the container.

Another aspect of the invention is a raised support which comprises a plurality of raised bosses on the interior of the container bottom that support the tea bag.

Another aspect of the invention is providing an optional perforated platform retained over the plurality of raised bosses, or protrusions extending from the walls of the container.

Another aspect of the invention is a raised support which comprises a raised perforated platform having integral underside protrusions to support the platform away from the bottom of the container.

Another aspect of the invention is a tea bag container manufactured from a non-porous food grade material suitable for retaining a liquid. Another aspect of the invention is a tea bag container manufactured from a hard or semi hard material such as plastic, silicone, glass, ceramic, porcelain, wood, or metal.

Another aspect of the invention is a flexible double-wall tea bag container forming an outer container and an inner container, wherein the inner container is fluidly coupled to the outer container.

Another aspect of the invention is a flexible rim of the tea bag container which generally forms a rectangular shape.

Another aspect of the invention is a flexible double-wall tea bag container with a spout for pouring liquid from the outer container.

Another aspect of the invention is a flexible tea bag container configured so that squeezing the outer walls of the container will compress a tea bag retained within the inner container and drain excess liquid tea essence into the outer container.

Another aspect of the invention is a flexible tea bag container manufactured from a non-porous, flexible, food-grade material for holding a liquid such as plastic, rubber, plasticized paper, silicone, food grade silicone, Santoprene™, and so forth.

Another aspect of the invention is a disposable flexible tea bag container manufactured from a food grade material designed to be used once and thrown away.

Another aspect of the invention is a container for collecting liquid from a wet tea bag and extracting tea liquid that comprises a container for receiving a tea bag, having generally vertical walls terminating in a rim, and a bottom, the walls of the container made of a flexible material, where a tea bag retained in the container is compressed in response to a compression force applied to the walls of the container, and where the amount of liquid drained from the tea bag and into the container is increased in response to the compression force.

A further aspect of the invention is where the vertical walls comprising first and second side walls and first and second end walls the first and second side walls are longer than the first and second end walls, the rim has a first position and a second position, where the first position of the rim generally defines an oval opening, where the second position of the rim generally defines a circular opening, where the rim moves from the first position to the second position when compressive force is applied to the first and second end walls, and where the second position of the rim is adapted to receive a tea bag in the container.

A further aspect of the invention is a spout positioned in the rim of the first end wall, a gripping region positioned on the first and second side walls, and a plurality of vertical ribs positioned on the first and second side walls and extending to the bottom of the container.

Another aspect of the invention is one or more structures, the structures extending up from the bottom of the container and where a tea bag is retained in the container and on the top of the extending structures.

A still further aspect of the invention is a method for extracting tea liquid from a wet tea bag, comprising providing a container for receiving and compressing a tea bag, the container comprising a container bottom, a plurality of substantially vertical container walls, a lid, the lid having a downward protrusion, and a tea bag support coupled to the container bottom, placing a wet tea bag on the support in the container, compressing the wet tea bag between the support and the lid protrusion, in response to which tea liquid drains from the tea bag to the container bottom, and pouring the tea liquid from the container.

A yet further aspect of the invention is a method for extracting tea liquid from a wet tea bag comprising providing a flexible container for receiving and compressing a tea bag, the flexible container having an inner container and an outer container, the outer container fluidly connected to the inner container, placing a wet tea bag in the inner container, compressing the outer container thereby compressing the inner container thereby compressing the wet tea bag, and in response to the compression tea liquid flows from the compressed tea bag, into the inner container, and further into the outer container, and pouring the tea liquid from the outer container.

A further aspect of the invention is a method for extracting tea liquid from a wet tea bag comprising providing a flexible container for receiving and compressing a tea bag, the flexible container having first and second side walls, first and second end walls shorter than the side walls and a continuous rim, compressing the first and second end walls to move the rim from a generally oval cross section to a generally circular cross section, placing a wet tea bag through the circular rim and in the container, compressing the first and second side walls thereby compressing the wet tea bag, and in response to the compression tea liquid flows from the compressed tea bag, into the container, and pouring the tea liquid from the container.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 12. It will be appreciated that the apparatus may vary as to configuration and as to details of the parts, and that the method may vary as to the specific steps and sequence, without departing from the basic concepts as disclosed herein.

Figure 1:
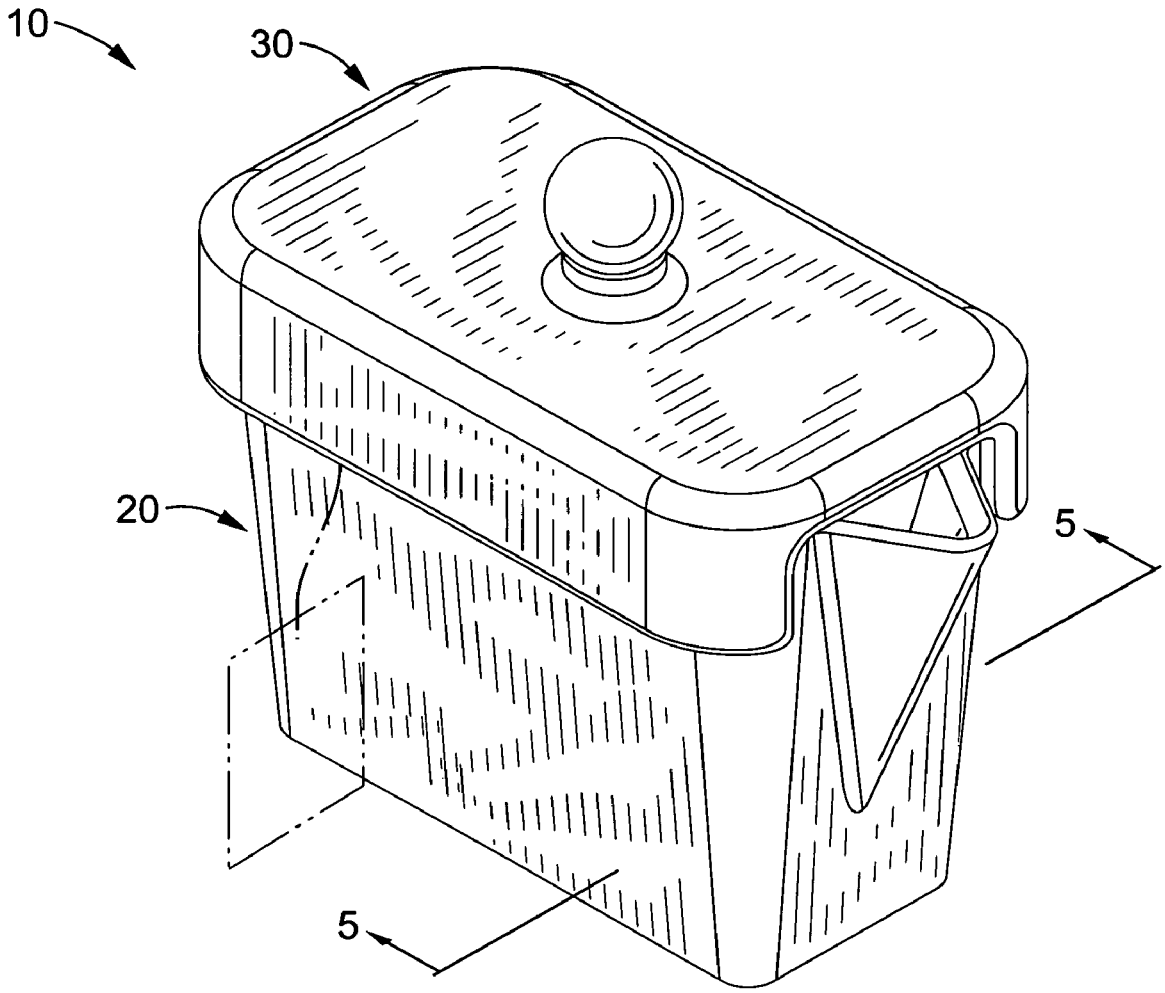
FIG. 1 is a perspective view of a tea bag press and container assembly according to an embodiment of the present invention, shown with a container base and a lid in an assembled configuration.

FIG. 1 through FIG. 6 illustrate an embodiment of a vertical compression tea bag press and container assembly according to the present invention. FIG. 1 illustrates the tea bag press and container assembly 10 with container base 20 and lid 30. Lid 30 is preferably configured with an integral press element which protrudes from the underside to engage a tea bag retained on a support positioned above the bottom of the container.

Figure 2:
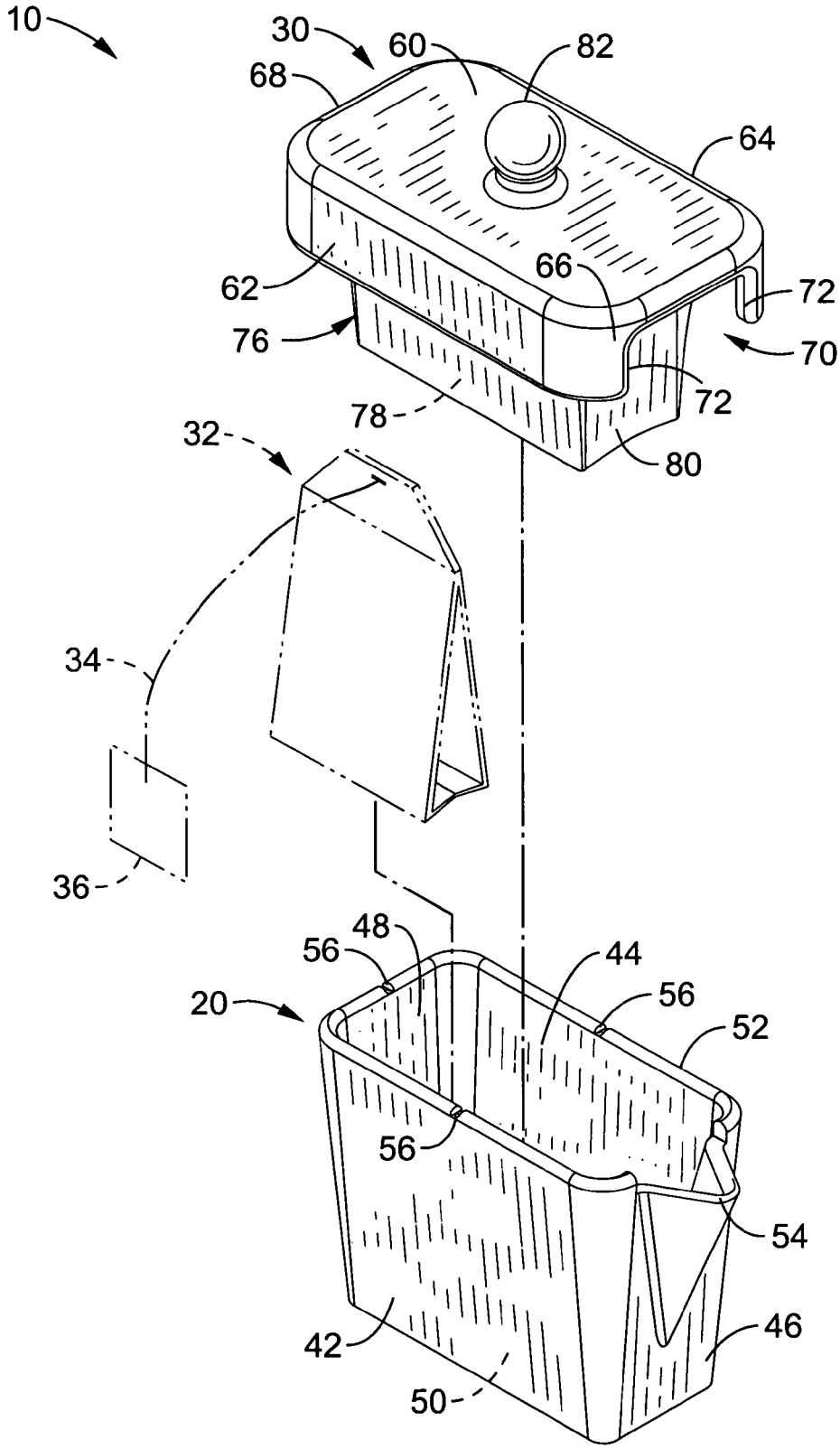
FIG. 2 is an exploded view of the tea bag press and container assembly depicted in FIG. 1, showing detail of the lid and container base.

FIG. 2 is an exploded view of the tea bag press and container assembly 10 shown with container base 20 and lid 30. A tea bag 32 with string 34 and label 36 is shown in phantom to provide perspective and clarity. Stringless tea bags are also accommodated in present tea bag press-container assembly 10.

Container base 20 is defined by first and second side walls 42, 44, coupled to first and second end walls 46, 48 which attach to container bottom 50. A rim 52 is defined by the top of walls 42, 44, 46, 48. A pour spout 54 is preferably positioned in first end wall 46, although any convenient type, shape, or position may be adopted for the pour spout without departing from the teachings of the present invention. To aid retention of a tea bag string 34, rim 52 may optionally contain one or preferably a plurality of notches 56.

Container base 20 is shown in a generally rectangular cross section configuration, although it will be appreciated that other shapes, such as any geometric shape suitable for holding a tea bag, (i.e. oval, polygon and so forth), may be generally adopted without departing from the teachings of the present invention. Furthermore, the walls of the container may be adapted with differing forms and shapes, such as concave or convex wall configurations. Container base 20 is preferably sized to accommodate commercially available individual tea bags and to comfortably fit the grasp of an individual. An optional liquid level indicator (not shown) may be disposed on the interior of container base 20 to indicate a safe amount of boiling water for brewing or re-brewing tea within the tea bag container. For example, a dry stringless tea bag may be placed in container 20 and filled to the level indicator with boiling water for brewing.

Lid 30 is defined by lid top 60 whose perimeter is preferably coupled to first and second side skirts 62, 64, and to first and second end skirts 66, 68. Skirts 62, 64, 66, 68 are configured to fit over container rim 52. In another embodiment (not shown), lid top 60 is configured to adapt to rim 52 without lid skirts. It should be appreciated that lid top 60 may be coupled to the upper portion of the tea bag container using any convenient interfacing means, known to one of ordinary skill in the art, without departing from the teachings of the present invention. A lid handle 82 is preferably attached to lid top 60 to facilitate handling, pressing and pouring. In other configurations (not shown) lid 30 is formed without a protruding handle or is adapted with recesses, finger notches, or the like as known in the art, to facilitate convenient grasping of top 30. In another mode of the invention (not shown), container base 20 may be configured with a handle to facilitate handling and pouring.

Pour spout opening 70 is shown in a preferred position within first end skirt 66 and has lid alignment lips 72 that correspond to the configuration of pour spout 54, although it may be positioned extending from a corner or side of container 20. In another embodiment (not shown), a sideward extending pour spout is omitted, and lid 30 is adapted with a fluid communication port, such as by incorporating at least one aperture through which tea liquid may be poured. For example a portion (i.e. near a corner) of top 30 may be removed or adapted with an aperture through which liquid may be poured.

A press element 76 is preferably coupled beneath lid top 60 and adapted to fit within the space defined within walls 42, 44, 46, and 48 of container 20. Less preferably a press may be utilized which is separate from lid 30, or that separably joins to lid 30. Press element 76 has bottom press surface 78 that is configured to extend into container base 20 and press a tea bag 32 (illustrated in FIG. 5). Bottom press surface 78 is shown in a preferred concave configuration to facilitate pressing a tea bag 32 without tearing or bursting, while other configurations may also be utilized, such as flat surface, convex, perforated, and so forth. Press element 76 is shown with end wall 80 in a preferred recessed and concave configuration to facilitate fluid retention and pouring.

Although shown in a simple solid configuration, it should be appreciated that the press element may be implemented in a number of alternative forms without departing from the present invention, the following being provided by way of example. In another press embodiment, press element 76 may be configured as a porous element thereby displacing a less significant portion of the container volume (reducing the chance of tea spillage when using the press) while retaining the ability to compress the tea bag. The reduced displacement volume plunger may be configured as a stem and foot protrusion, a hollow plunger with a plurality of flow apertures, or similar embodiments wherein the press element is configured to compress the tea bag without displacing significant portions of the tea container volume. The press element may be optionally implemented as a compliant press element, wherein the force applied by the press is regulated and/or controlled separately from closing the container lid. For example, the lower portion of the press element may be coupled through a biasing member, such as a spring, to the lid. The force applied upon the tea bag, when pressing the lid onto the container, is thereby limited by the force generated by the biasing member. The compression supplied by the press may be controlled, such as by coupling a movable handle on the exterior of the lid to a moveable plunger, with or without a biasing member. In this case the user can advance the plunger to apply selected pressure to the wet tea bag from the underside of the plunger press element.

Figure 3:
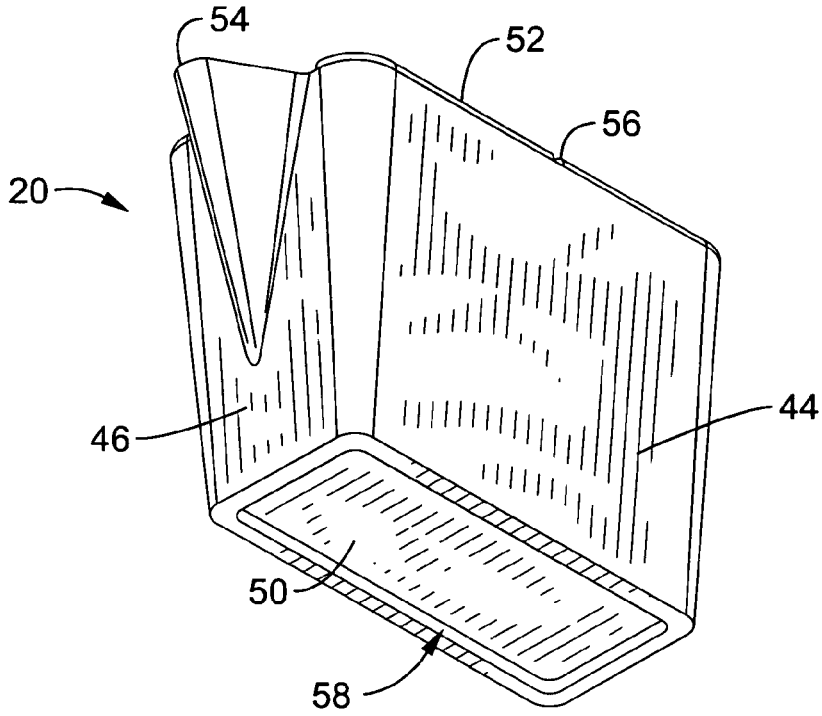
FIG. 3 is a perspective underside view of the tea bag press and container shown in FIG. 2.

FIG. 3 depicts the underside of tea bag container base 20, which illustrates a preferred embodiment of container bottom 50 having a recess 58 for stability and protection of manufacturers imprints (not shown). In another preferred embodiment short feet (not shown) may extend from container 20, such as in an extension of the corner walls. Reducing the contact area on the bottom of the container can enhance stability because a smaller portions of a support surface is required to be flat and free from obstructions. Furthermore, the edges of the extended feet provide a means for stabilizing the container on the edge of a saucer or other non-planar and/or irregular surface. In other modes (not shown), the bottom of container 20 may be flat or adapted with clips, pads or slots to mate with a saucer or a saucer rim. In further modes (not shown), the bottom of container 20 may be adapted to mate with a tray or other serving apparatus.

Figure 4:
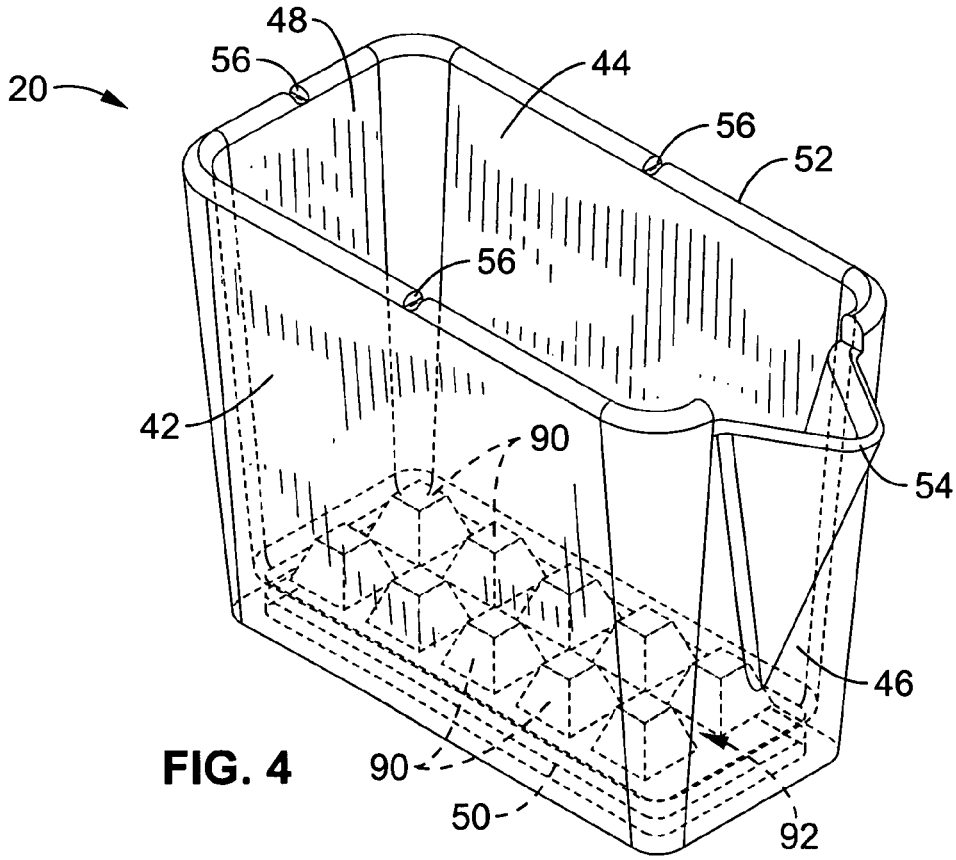
FIG. 4 is a perspective view of the tea bag container according to an aspect of the present invention, shown without the press element to more clearly depict the use of raised support bosses.

FIG. 4 illustrates by way of example an interior of tea bag container base 20 having a preferred means for supporting a wet tea bag above the bottom of container 20. One preferred support means is the use of a plurality of pedestals or raised bosses 90 on the interior side of container bottom 50. These raised bosses are preferably formed as sufficiently smoothed and rounded surfaces, so as to prevent tearing when a wet tea bag is pressed against the raised bosses. A reservoir 92 is defined by container bottom 50, walls 42, 44, 46, 48 and the tops of raised bosses 90. A wet tea bag supported on raised bosses 90 (shown in FIG. 5), will drain into reservoir 92. In other modes (not shown), support for a tea bag may be provided by ridges, bumps or other raised formations extending from container bottom 50. In further modes (not shown), support for a tea bag is a strainer, spacer or other supporting element positioned above container bottom 50 of container base 20.

Although less preferable, the support means in other embodiments (not shown) can be bottom 50 with no formations, with slight indentations, or with grooves.

Referring again to the raised bosses shown in FIG. 4, a perforated platform (not shown) may be optionally retained (preferably as a user insertable element) over the raised protrusions extending up from container bottom 50. By way of example, the perforated platform may comprise a section of porous material such as structural screen, a planar plastic section with a plurality of smooth edged perforations, or any convenient porous element capable of retaining the tea bag for drainage in separation from container bottom 50. In some applications the use of a perforated platform can reduce vertical displacement stresses on the tea bag, aid in preventing portions of the tea bag from being pressed down into the liquid reservoir at the bottom of container 20, and increase the relative volume of the reservoir at the bottom of the container prior to contact with tea bag from which excess liquid is being drained.

Figure 5:
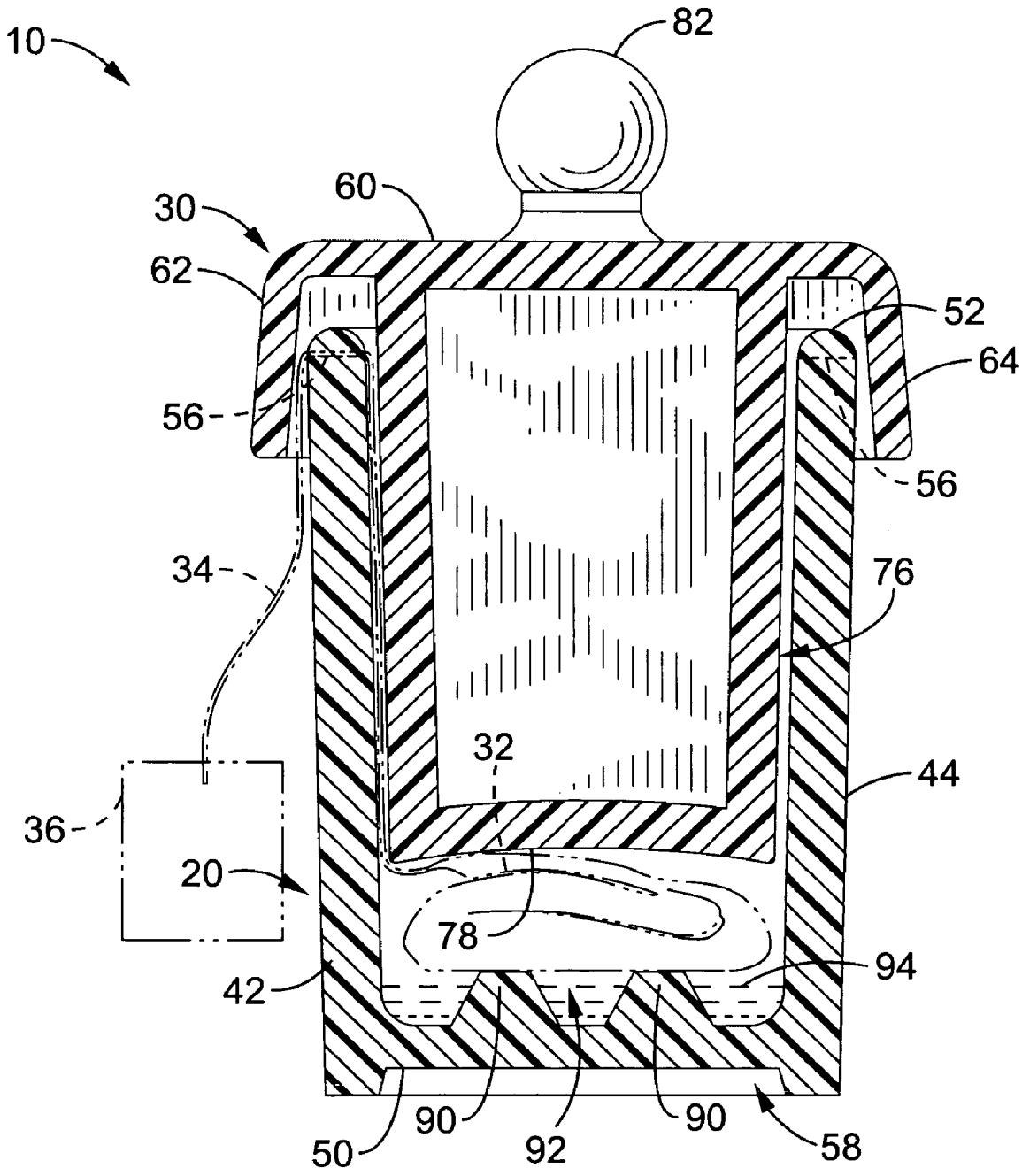
FIG. 5 is a cross-section of the tea bag press and container taken through line 5—5 of FIG. 1, showing tea bag compression between the a press and raised support bosses.

FIG. 5 is a tea bag container and press 10 shown with a wet tea bag upon compression of press 76 toward raised protrusions 90. A wet tea bag 32 is shown, with optional tea bag string 34 and tea bag label 36, supported on raised bosses 90 above the bottom interior of container 20. Lid 30 is placed over rim 52 of container base 20 with press 76 resting on tea bag 32 and in response to pressure applied to lid 30, bottom press surface 78 has compressed tea bag 32 against raised bosses 90 draining liquid 94 from tea bag 32 which collects in reservoir 92. The tea bag is shown with string 62 optionally resting in a notch 56. It should be appreciated that additional hot water may be added to tea bag container 10 for generating additional tea essence from tea bag 32, which can be added to a cup of tea.

Figure 6:
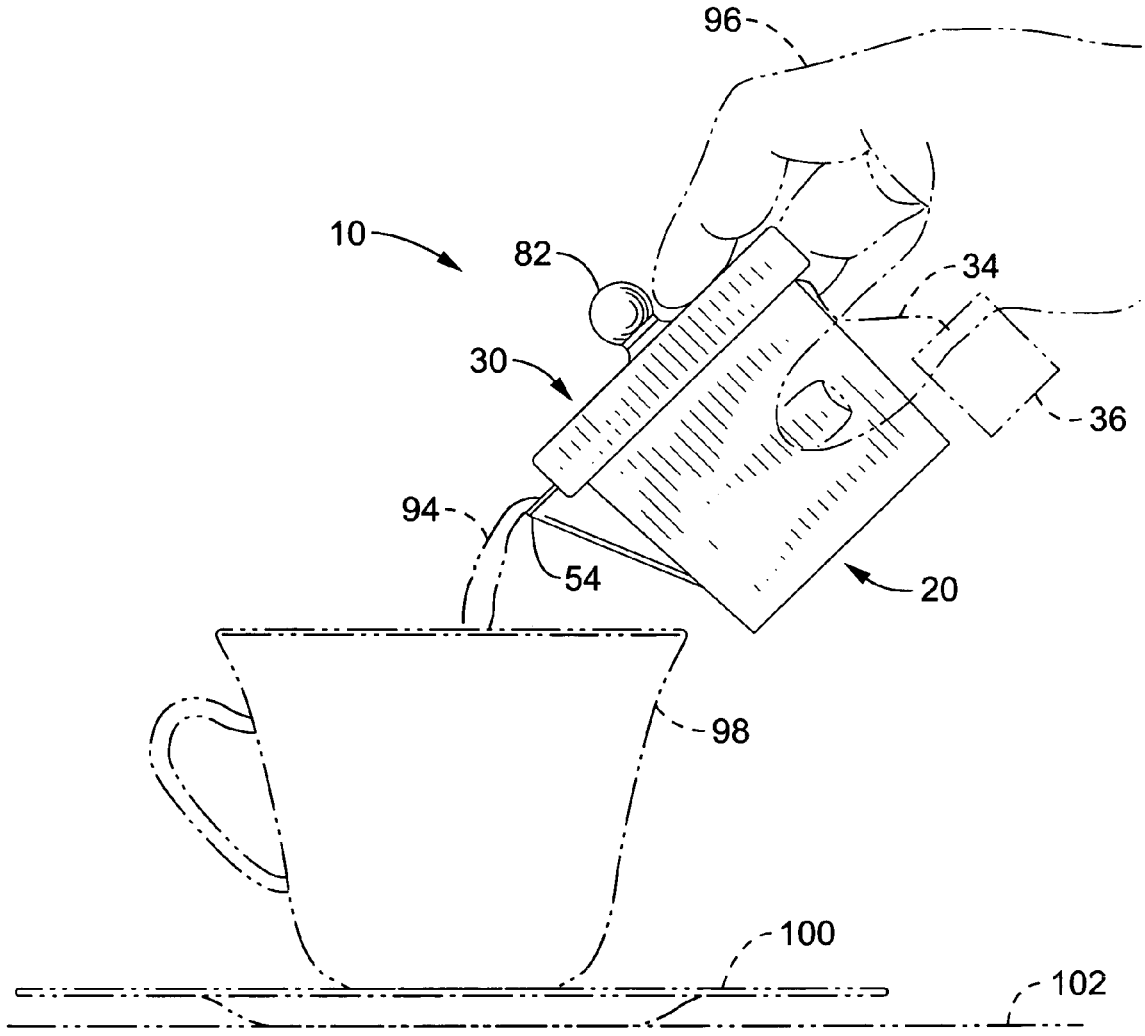
FIG. 6 is a side view of the tea bag press and container according to an aspect of the present invention, shown being utilized by pouring liquid from the tea bag press-container assembly into a cup.

FIG. 6 illustrates the tea bag container and press 10 shown in use for draining liquid from the tea bag after initially brewing a tea beverage. For tea bags with strings attached, after a tea bag has brewed, container base 20 is typically held above a teacup or tea pot, so the wet tea bag can be transferred by holding string 34 without dripping anywhere but into the tea cup, tea pot or into container base 20. After the tea bag is placed in container base 20, it can be concealed by placing lid 30 on container base 20. Pressing on lid 60 or lid handle 82 directs press element 76 to compress tea bag 32 against the porous support means provided by raised protrusions 90. As a result of tea bag compression, tea essence liquid 94 collects in reservoir 92 below the tops of raised bosses 90.

FIG. 6 also depicts handling of tea bag press-container assembly 10 for utilizing the tea essence liquid. After the tea bag is compressed inside container base 20, tea bag container and press assembly 10 is tilted, such as by the hand 96 of an individual, so that tea essence liquid 94 pours from spout 54 and into tea cup 98. By grasping container base 20 with thumb and middle fingers and pressing lid 30 or lid handle 82 with a forefinger, it is possible to press and pour in one operation. In one embodiment (not shown), tea bag container and press assembly 10 is configured to set securely on saucer 100. Typically, tea bag container 10 is adapted to set securely on horizontal surfaces 102. Boiling water can be added to container base 20 prior to pouring to brew tea concentrate or additional tea. The used tea bag (wet or dry) can be disposed of by inverting container base 10 over a proper disposal receptacle.

The present invention also simplifies the use of stringless tea bags (with no string or other elongated handling member attached), wherein the user is not required to fish around in the tea cup using a spoon for retrieving the tea bag and then risk staining surfaces and clothing with dripping tea as the tea bag is removed from the cup. One method of utilizing the present invention with a stringless tea bag is to place a dry tea bag in container base 20 over raised bosses 90. A small amount (i.e. one ounce) of hot water (preferably boiling) is poured over the tea bag. The tea is allowed to steep for a desired period of time, such as one to two minutes, thereby brewing a tea concentrate. The tea concentrate may be utilized in a number of ways, such as by pouring it into a cup with additional liquid (hot or cold) as desired. Stronger tea or additional tea is produced by pressing on lid 30 and pouring tea essence into the cup. By utilizing the present invention, an individual does not need to handle the tea bag, even if it stringless, and need not risk staining their own clothing or nearby surfaces.

Container base 20, lid 30 and press element 76 can be fabricated from a variety of hard or semi-hard materials suitable for food service including plastics, recycled plastic, silicone, hard rubber, glass, ceramic, porcelain, treated paper, wood and metal such as stainless steel and silver, or a combination thereof. Materials that are inexpensive to manufacture and durable for handling and dishwashing are preferred, such as plastic, glass and ceramic. Inexpensive materials suitable for a single use, such as treated paper, may also be utilized for producing disposable versions of the present invention. A material that provides insulation between fingers on the outside and hot water on the inside of the container is preferred. In another preferred embodiment, an insulator sleeve, such as corrugated paper, is positioned outside of the container to provide additional insulation.

Figure 7:
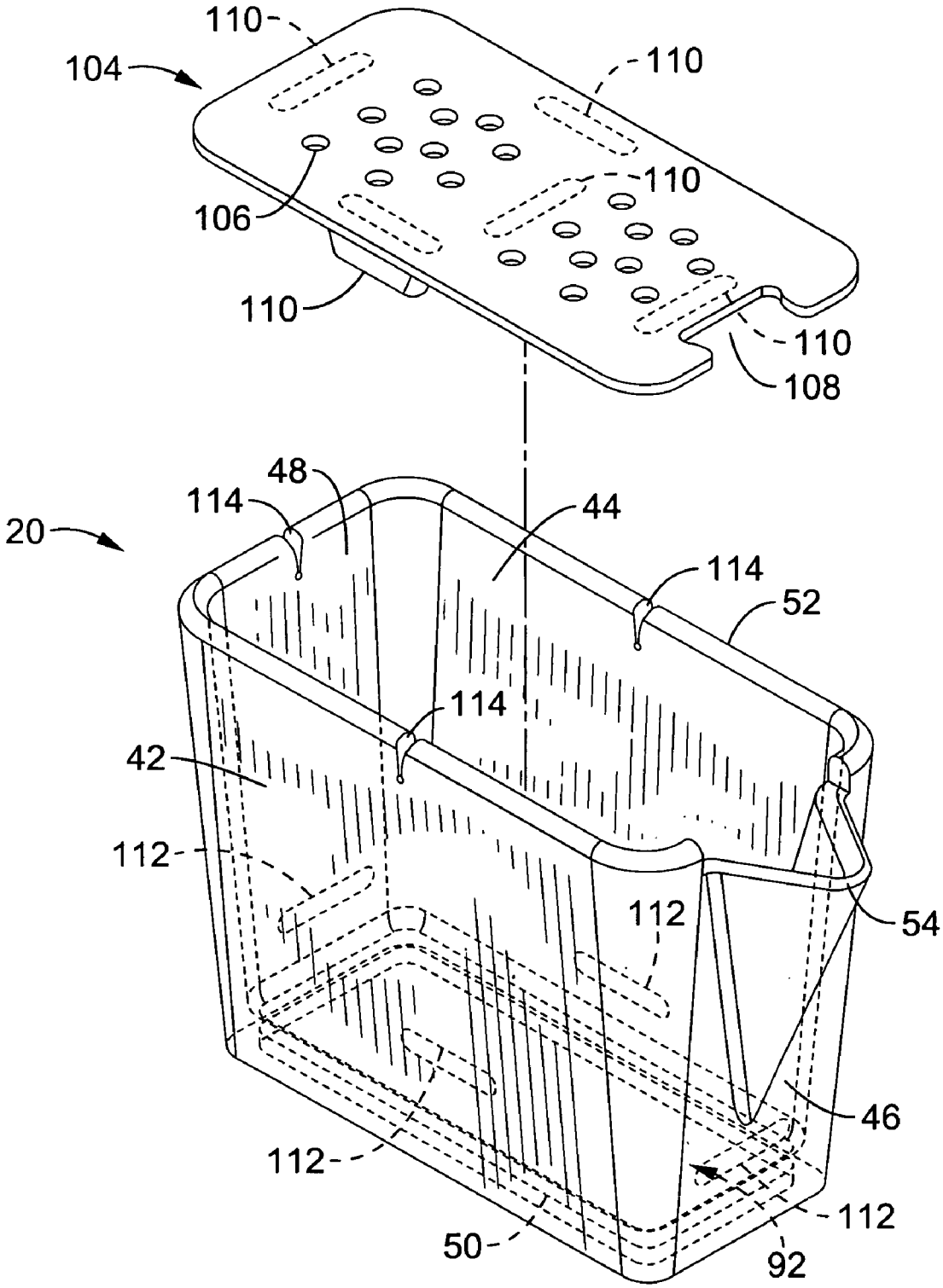
FIG. 7 is an exploded view of the tea bag container according to an aspect of the present invention, shown with a separable perforated support platform for creating a reservoir area between the platform and bottom of the container into which tea liquid is to be drained.

FIG. 7 is an alternate embodiment of the tea bag container and vertical press assembly according to the present invention. The preferred means for supporting the tea bag in this embodiment comprises a porous platform 104 which is retained in separation over the bottom of container 20. Porous platform 104 may be retained at a desired separation above the bottom of container 20, in a number of alternative ways. The use of a perforated platform was already described for being supported over raised protrusions 90. In this figure the perforated platform (or platform otherwise exhibiting liquid porosity) is shown being retained in container 20 without the inclusion of raised protrusions 90.

By way of example, perforated platform 104 is fabricated, such as in a molding process, with smooth edged apertures 106, shown as circular apertures with radiused top edges. Another aperture 108 is shown provided through which tea essence liquid is drained from the reservoir at the bottom of container 20 toward the spout. Support tabs 110 are shown extending from perforated platform 104 to maintain a desired separation from the bottom of container 20. It should be appreciated that supports within the interior of container 20 may be additionally or alternatively provided for maintaining perforated platform 104 separate from the bottom of container 20. By way of example, optional protruding ridges 112 are shown, which may be utilized as an alternative to support tabs 110, or for implementing a volume changeable tea liquid reservoir. Protruding ridges 112 may be implemented as separate sections as shown or as a circumferential protruding ring about the interior of container 20. Alternatively, the lower portion of container 20 may be thicker near the base providing a protruding step or the container shaped with a step providing a protrusion within the interior for supporting perforated platform 104. It should be appreciated that perforated platform 104 may be supported peripherally from the walls of container 20, vertically from supports extending upwardly from the bottom of container 20, vertically from supports extending downward from perforated platform 104, and supported by combinations thereof.

In a further mode of this embodiment, perforated platform 104 is configured to be an optional support means and bottom 50 as a less preferred support means.

This embodiment generally provides a predetermined amount of tea essence reservoir space within the container. It should also be appreciated that perforated platform 104 may be configured for providing a selectable reservoir volume. For example inserting perforated platform 104 into container 20 with a first side up to provide a first reservoir volume, or inserting platform 104 with a second side up to provide a second reservoir volume. The two reservoir sizes can be provided by configuring perforated platform 104 with different depth support tabs on either side, or utilizing tabs or a skirt on one side which engages protruding ridges 112, tabs, or other supports on the interior of container 20, or other mechanisms for adjusting the separation between the perforated platform 104 and the bottom of container 20.

An alternately shaped string notch 114 is also shown in the figure to allow squeezing tea from the tea bag string, such as to prevent dripping and staining, and a retention location which allows the string to move into container 20 as desired, such as in response to compression from press element 76 which compresses the tea bag and moves the top of the tea bag lower in container 20. Notch 114 is exemplified with a tapered central section leading to a generally circular terminating aperture. It should be readily appreciated from the examples provided herein, that although a tea string notch, or notches, are not required they may be incorporated in numerous alternative forms without departing from the teachings of the present invention.

Figure 8:
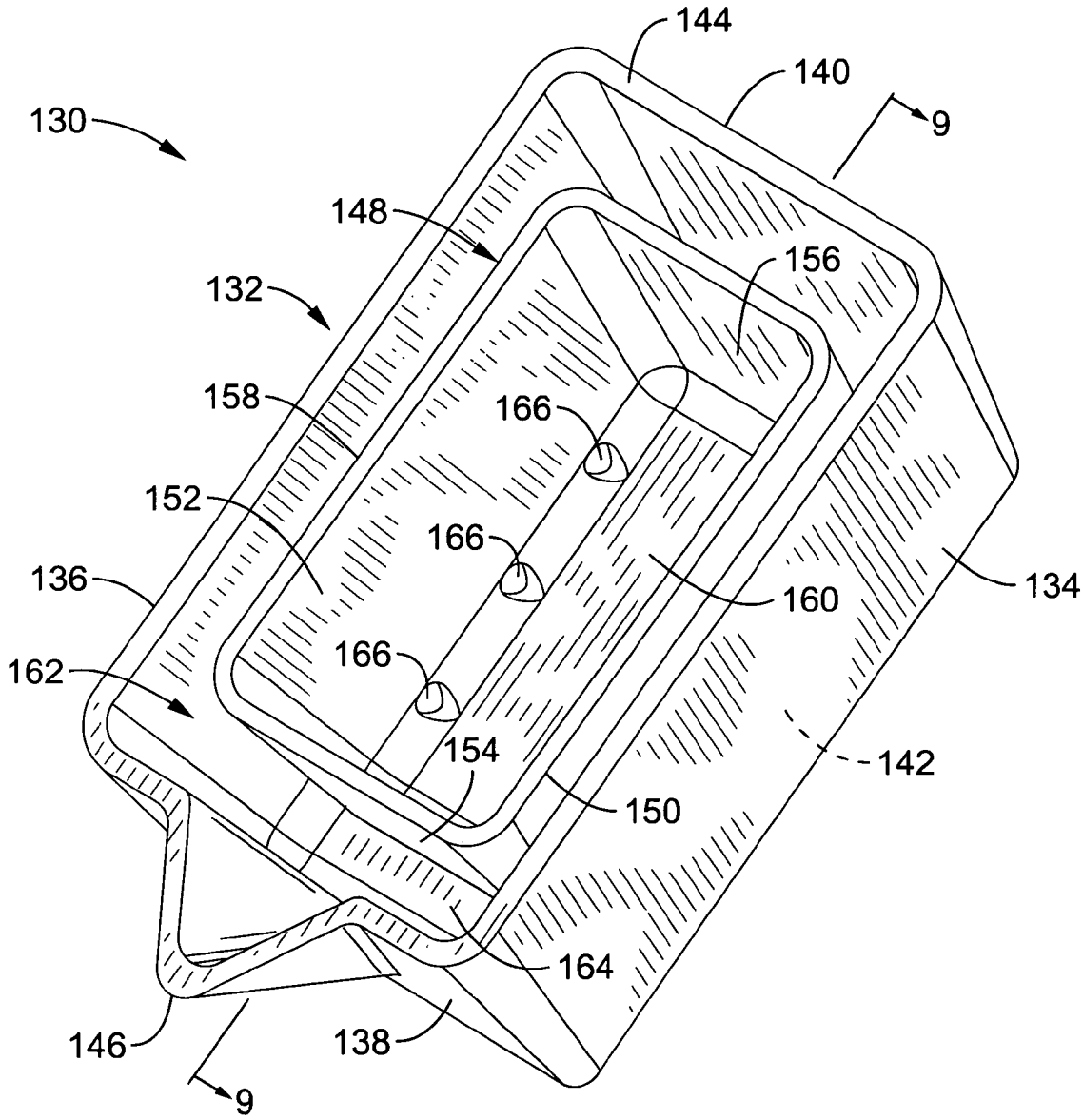
FIG. 8 is a perspective top view of a flexible tea bag container and sideward press according to an embodiment of the present invention for retaining and squeezing a wet tea bag from the sides of the container.
Figure 9:
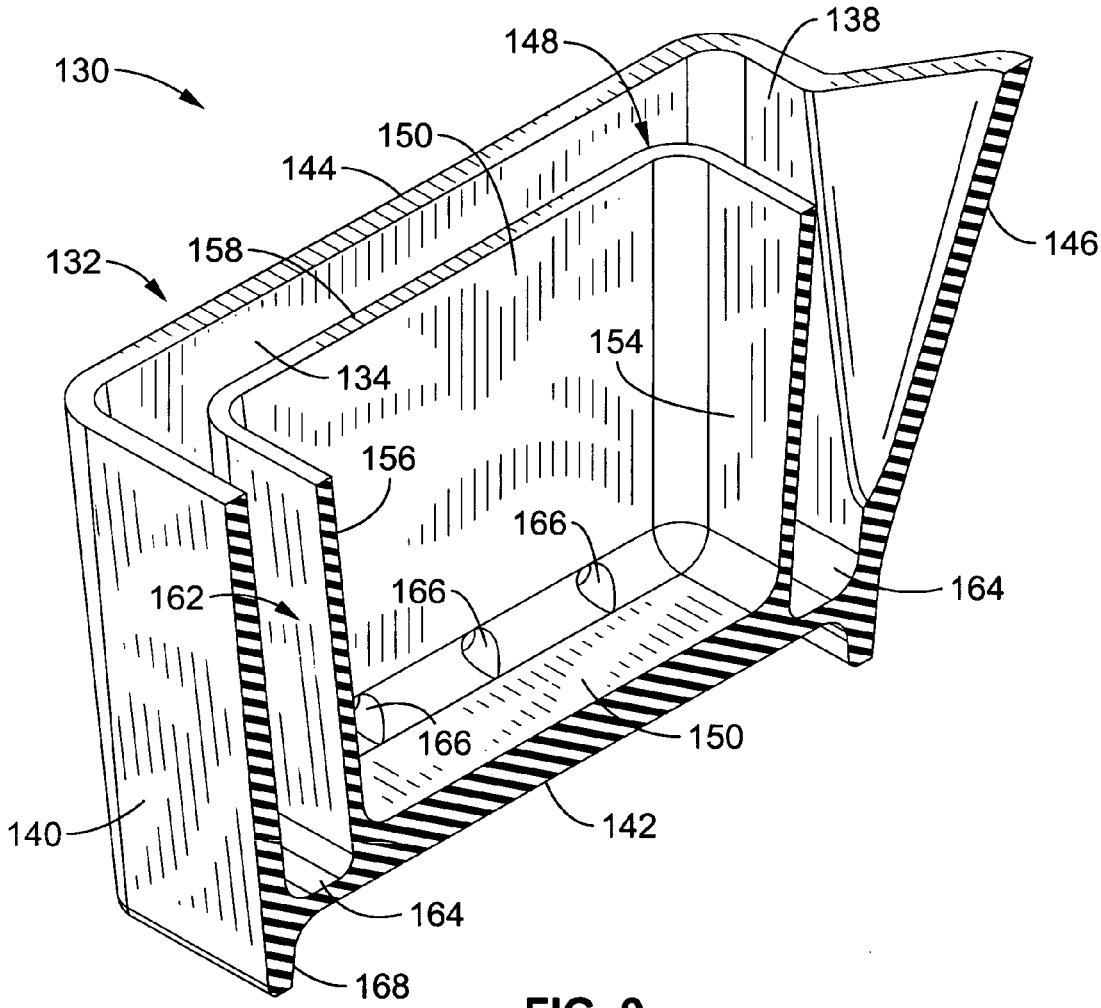
FIG. 9 is a cross-section view of the flexible tea bag press and container shown in FIG. 8.
Figure 10:
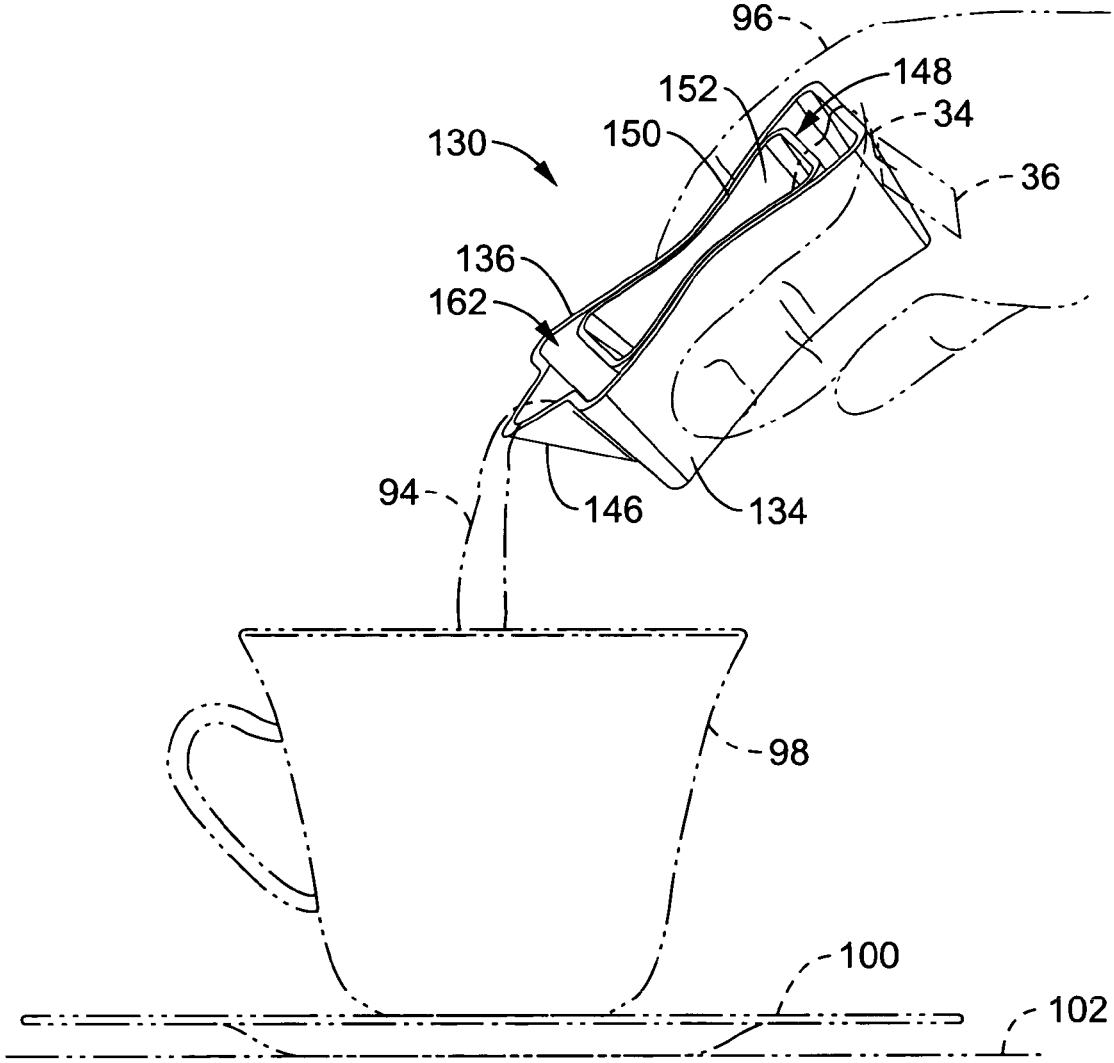
FIG. 10 is a perspective view of the flexible tea bag press and container of FIG. 8, shown being utilized by an individual squeezing the flexible tea bag container to direct additional tea essence into a tea cup.

FIG. 8 through FIG. 10 illustrate an embodiment 130 of a side compression tea bag press and container according to the present invention. In FIG. 8 and FIG. 9 the upper opening in the inner and outer tea bag containers is visible. Outer container 132 is shown defined by outer side walls 134, 136, outer end walls 138, 140 and an outer bottom 142. The top of outer walls 134, 136, 138, 140 form outer rim 144. A pour spout 146 is positioned in outer end wall 138. Inner container 148 has inner side walls 150, 152 and inner end walls 154, 156, whose tops form inner rim 158. Inner container 148 has an inner bottom 160 that is higher than the interior of the bottom 142. It should be appreciated that although inner bottom 160 is shown for simplicity as a substantially planar section, it may have a raised central section, such as a ridge, plateau or similar, for elevating the tea bag into a more compressible region of the inner container. In some cases raising the tea bag can increase the available compression that can be applied by the inner container on the portion of the tea bag which contains the bulk of the tea leaves.

Between outer walls and inner walls is defined an interstitial space 162 within outer container 132 and with outer bottom 154 further defining a reservoir trough 164. Apertures 166 fluidly connect inner container 148 with reservoir trough 164. Apertures 166 are shown located in the lower portions of inner side walls 150, 152 but can be positioned in other configurations to accomplish the fluid connection between inner container 148 and reservoir trough 164. The inner porous container within this sideward compression press embodiment is configured to be volumetrically compliant for applying compression forces on a retained tea bag for draining liquid tea essence through the inner porous container into the outer container, or interstitial space between inner and outer container, for being poured therefrom, such as into a tea cup. In a preferred embodiment, flexible tea bag press-container 130 has a recess 168 (FIG. 9) in outer bottom 142 for stability and protection of manufacturers imprints.

FIG. 10 illustrates the flexible tea bag press-container 130 in use for draining a tea bag retained within inner container 150 being squeezed by an individual 96 along outer side walls 134, 136. Inner side walls 150, 152 are correspondingly compressed, thereby squeezing the tea bag in inner container 148 to drain liquid tea essence 94 into reservoir trough 164 through apertures 166. By way of example, liquid tea essence 94 is shown being poured into cup 98 through spout 146 by tilting flexible tea bag press-container 130 during or after squeezing. It should be appreciated that a small amount of boiling water can be poured into inner container 148 to brew or re-brew tea before pouring. Tea essence can then be extracted by squeezing and pouring, such as into cup 98. Referring again to the figure, the bottom of flexible tea bag press-container 130 is preferably adapted to set securely on a substantially horizontal surface 102. Alternatively, flexible tea bag press-container 130 may be configured to set securely, or be secured, on saucer 100, or other surface. When it is no longer desirable to brew additional tea with a given tea bag, the tea bag may be removed from tea bag press-container by inverting flexible tea bag press-container 130 over a proper disposal receptacle.

Within any of the embodiments described herein, one or more liquid level indicators may be disposed on inner container 148, such as for indicating the safe or desired amount of hot (boiling) water to add for brewing tea essence.

The material selected for tea bag press-container 130 is preferably a sufficiently flexible material to allow proper compression of a wet tea bag. The material should also have shape memory properties, wherein it returns to its original shape after compression, such as to a rectangular shape for the present example embodiment. Although the two-walled configuration with a container-inside-a-container provides additional insulation from a hot tea bag, it is preferable that the material be capable of safe handling and insulating fingers from boiling water. Flexible materials that exhibit sufficient thermal absorption capacity so that a user will not be burned or injured squeezing a teabag removed from boiling water and placed in the container are preferred. Materials such as Santoprene™ and FDA approved silicones that are rated from 450° F. to 500° F. are well suited for this application. It is desirable to utilize a material that does not alter the taste of the tea. In a preferred embodiment, an insulating material, such as corrugated paper is placed on the outside of the flexible container for additional insulation.

Flexible materials such as plastics, recycled plastic, rubber, silicone, plasticized paper, treated paper or other flexible food-grade material suitable for holding liquids, may be utilized alone or in combinations thereof. A food-grade flexible material that can be manufactured at a low cost is desired. A sufficiently inexpensive version is particularly well-suited for use as a disposable tea bag press-container, such as can be utilized once (or for very limited number of use cycles) and thereafter discarded.

Although depicted in a double container embodiment, the sideward compression tea bag press and container of the present invention may be embodied in numerous alternative ways without departing from the teachings of the present invention, the following being provided by way of example. In another embodiment (not shown), flexible tea bag press-container 130 may have ribs, struts, or braces in the interstitial space to maintain interstitial spacing during the squeezing process for improved fluid retention or squeezing efficacy. In still another embodiment (not shown), flexible tea bag press-container may be configured with ribs, struts, braces, plates or other elements in the inner container for improved fluid retention or to improve squeezing efficacy. In a further embodiment, one or more additional walls or plates are added in interstitial space 162.

Still further embodiments may be implemented wherein the compression applied to the wet tea bag as provided by the inner container of FIG. 8 through FIG. 10, is alternatively achieved by articulating one or more elements interior of the outer container, such as portions of the inner container. In a first example, the inner container may be replaced with two halves (i.e. substantially planar) extending up from a raised platform over the container bottom. The tea bag is inserted between the two halves, which are brought toward one another (i.e. forming a narrow base triangle upon closing the top of the halves), wherein tea essence is drained through the ends of the tea bag as well as preferably through drain apertures located along the lower portions of the two planar halves. By extending the planar halves above the rim of the outer container, the uppermost portions of the planar halves (or handles thereon) may be grasped and compressed without the need to flex the outer container, wherein the entire sideward press-container apparatus may be fabricated from a less compliant solid material, such as thermally formed plastic. Furthermore, in a second example, a single planar section may be hinged to a platform extending from a raised side of the outer container, wherein the tea bag is compressed between the planar half and the interior of the outer wall to drain the tea essence liquid into the outer container for use. In view of these alternative embodiments and the discussion presented herein, it should be appreciated that a number of alternatives and variations may be implemented without departing from the teachings of the present invention.

Figure 11:
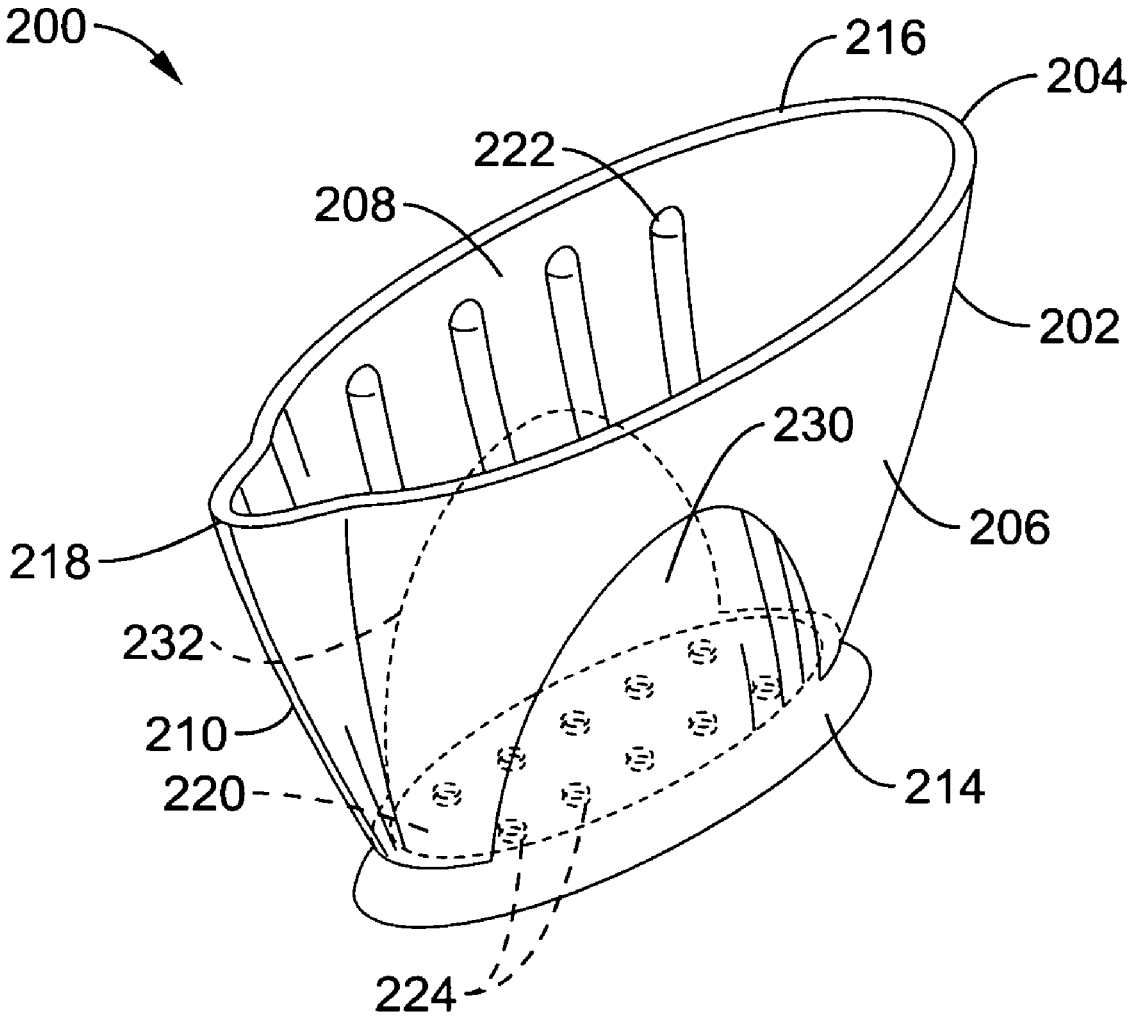
FIG. 11 is a perspective view of a single wall flexible tea bag press according to an embodiment of the present invention.
Figure 12:
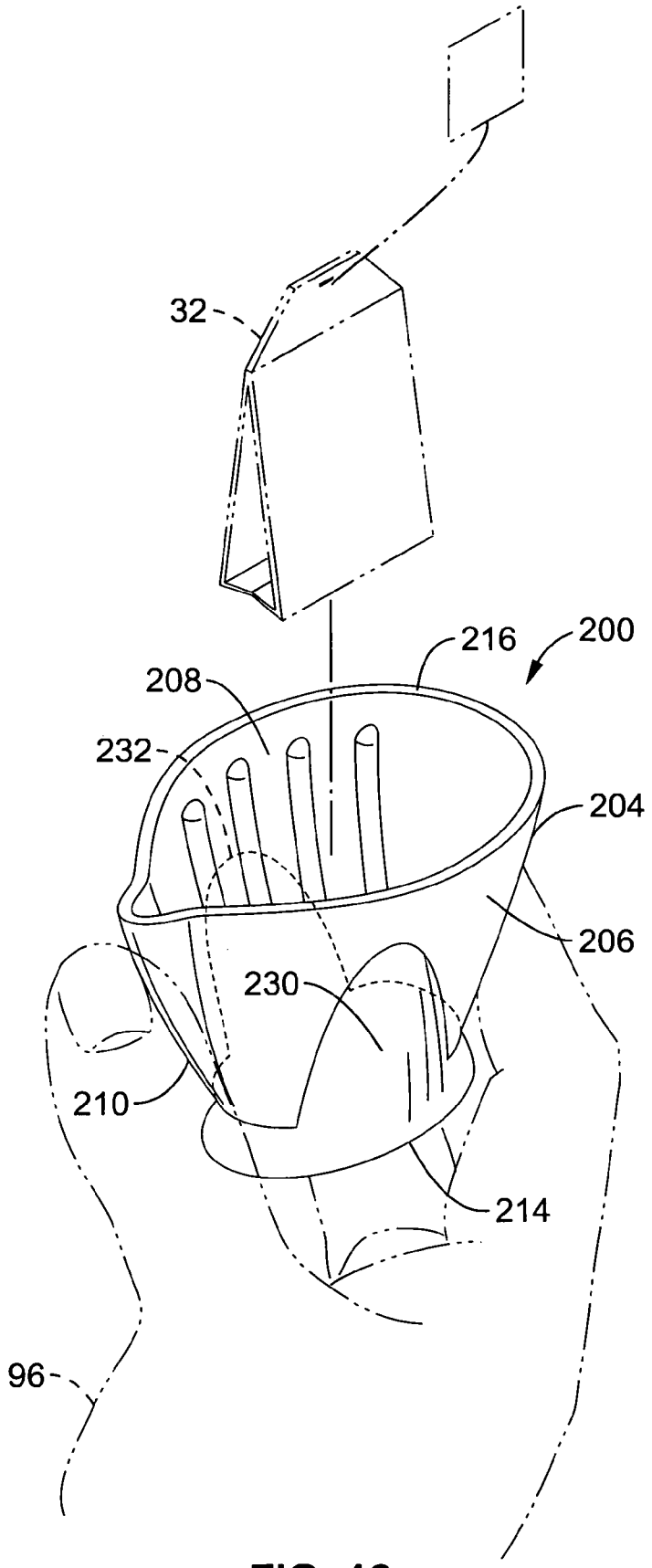
FIG. 12 is a perspective view of the flexible tea bag press shown in FIG. 11 being squeezed by thumb and forefinger to increase the opening to receive a tea bag.

FIG. 11 and FIG. 12 illustrate perspective views of a single wall embodiment of a side compression tea bag press 200 used in a manner previously described in FIG. 8 through FIG. 10 and in accordance with the present invention. Tea bag press 200 is preferably made from a compliant material that exhibit sufficient thermal absorption capacity so that a user will not be burned or injured squeezing a teabag removed from boiling water and placed in the container are preferred. Materials such as Santoprene™ and FDA approved silicones that are rated from 450° F. to 500° F. are well suited for this application. Additionally, plastics, recycled plastic, rubber, silicone, plasticized paper, treated paper or other flexible food-grade material suitable for holding liquids may be used.

In FIG. 11, tea bag container 202 has continuous vertical walls designated as an end wall 204, a first side wall 206, a second side wall 208 and a spout wall 210. Container 202 has a base 214 coupled to walls 204, 206, 208 and 210 with a perimeter that extends out past the junction of the aforementioned walls. Base 214 is configured concave or flat on the bottom surface to support container 202 in an upright position when set on a table or saucer. Container 202 also has a continuous top rim 216 that generally defines an oval shape above walls 204, 206 and 208 with a pour spout 218 formed on the top of spout wall 210.

Bottom surface 220 of container 202 is coupled to walls 204, 206, 208 and 210 and is generally planar and parallel to base 214. In this illustration, bottom surface 220 has an elongated shape but can be oval, concave or rectangular. A plurality of ribs or ridges 222 are positioned vertically on the inside of first wall 206 (not shown for clarity) and second wall 208 and extend to bottom surface 220. Ribs 222 provide vertical rigidity for container 202, support for a wet teabag and squeezing efficacy. A plurality of raised bosses or structures 224 are preferably positioned on bottom 220 as a means to support and elevate a tea bag and facilitate pouring fluid. Less preferable as a support means (not shown) are no raised bosses, indentations or grooves in bottom 220.

An optional indentation region 230, to improve gripping with a thumb or forefinger, is positioned at the bottom exterior of first side wall 206. A matching indentation 232, shown in phantom, is positioned at the bottom exterior of second wall 208.

FIG. 12 illustrates a perspective view of the tea bag press 200 shown in FIG. 11 in a configuration for receiving a tea bag. End wall 204 and spout wall 210 are held between thumb and forefinger of individual 96. Lightly squeezing end wall 204 and spout wall 210 together deforms top rim 216 into a more circular cross section and provides a larger opening in top rim 216 in which to insert tea bag 32 into container 202.

In some instances, a tea bag will swing or spin when raised by the string making it difficult to insert through a rectangular or elongated opening. The more circular cross section of the opening makes insertion of a swinging or spinning tea bag easier. The more circular cross section also aids insertion of the tea bag for individuals with deficiencies in eye-hand coordination.

After tea bag 32 is inserted and walls 204, 210 are released, container 202 returns to its elongated shape. The thumb and forefinger of individual 96 can be positioned on the indentations 230, 232 on side walls 206, 208 and tea bag 32 can be squeezed between first and second walls 206, 208 in a manner previously described in FIG. 9 and FIG. 10 to extract tea essence.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for collecting and extracting tea liquid from a tea bag comprising:

an outer container having an opening on top for receiving the tea bag, vertical walls terminating in a rim, and a bottom; and an inner container having an opening on top for receiving the tea bag, vertical walls terminating in a rim, and a bottom coupled to the bottom of the outer container;

wherein the bottom of the inner container or lower wall portions of the vertical walls of the inner container are porous for draining the tea liquid from the inner container into the outer container;

wherein the tea liquid is drained from the tea bag retained in the inner container, into the outer container, in response to a compression force applied to a portion of the vertical walls of the outer container.

2. An apparatus as recited in claim 1, wherein the walls of the outer container are formed to provide the rim of the outer container with a generally rectangular shape.

3. An apparatus as recited in claim 1, wherein the walls of the inner container are formed to provide the rim of the inner container with a generally rectangular shape.

4. An apparatus as recited in claim 1, further comprising a spout positioned at a location in association with the rim of the outer container and configured for pouring the tea liquid from the outer container by tilting the apparatus.

5. An apparatus for collecting and extracting tea liquid from a tea bag comprising:

an outer container having an opening on top for receiving the tea bag, vertical walls terminating in a rim, and a bottom; and an inner container having an opening on top for receiving the tea bag, vertical walls terminating in a rim, and a bottom coupled to the bottom of the outer container;

wherein the bottom of the inner container or lower wall portions of the vertical walls of the inner container are porous for draining the tea liquid from the inner container into the outer container;

wherein the tea liquid is drained from the tea bag retained in the inner container, into the outer container, in response to a compression force applied to a portion of the vertical walls of the outer container;

wherein the bottom of the inner container comprises a portion of the bottom of the outer container.

6. An apparatus as recited in claim 5, wherein the inner container is configured for compression of the tea bag positioned in the inner container when the outer container is squeezed against the inner container.

7. An apparatus for collecting liquid from a tea bag after steeping said tea bag in the apparatus, comprising:

a container having an opening on top for receiving said tea bag;

said container having generally vertical walls terminating in a rim, said container having a bottom;

a spout positioned on said container and configured to provide a path through which liquids are capable of being displaced from said container in response to tilting of said container;

a lid adapted to an entire top opening, or a majority of said top opening, of said container, supporting means for supporting said tea bag configured to allow said liquid from said tea bag to drain to said bottom of said container; and compressing means for compressing said bag positioned on said supporting means toward increasing an amount of said liquid to be drained from said tea bag to said bottom of said container;

wherein said compressing means comprises a protruding portion of said lid which is directed to an interior region of said container upon placing said lid on said container;

wherein said protruding portion of said lid is configured to compress said a tea bag between said protruding portion and said supporting means;

wherein said protruding portion is further configured to substantially fit within said interior region of said container;

wherein said protruding portion is further configured to be a porous structure.

8. An apparatus as recited in claim 7:

wherein said supporting means comprises one or more structures extending up from said bottom of said container; and wherein a liquid containment reservoir is at least partly defined between said top of said one or more structures and said bottom of said container.

9. An apparatus as recited in claim 8, wherein an upper portion of said one or more structures are configured for draining said liquid from said tea bag being retained on said supporting means in response to gravity, or a compressive force, applied to said tea bag.

10. An apparatus as recited in claim 9, wherein said one or more structures comprise a plurality of raised bosses extending from said bottom of said container.

11. An apparatus as recited in claim 10, wherein said one or more structures are configured for retention of said tea bag at a distance from said bottom of said container.

12. An apparatus for extracting and collecting tea liquid from a tea bag comprising:

a container for receiving said tea bag, said container having generally vertical walls terminating in a rim, said container having a bottom;

said walls of said container comprising a flexible material;

wherein said tea bag is retainable in said container for being compressed in response to a first compression force applied to first respective portions of said vertical walls of said container;

wherein an amount of said tea liquid is drained from said tea bag and into said container, said amount of said tea liquid being increased in response to a second compression force applied to second respective portions of said vertical walls of said container;

wherein said container is adapted to retain said tea liquid extracted from said tea bag responsive to application of said second compression force;

wherein said vertical walls comprise first and second side walls and first and second end walls;

wherein said first and second side walls are longer than said first and second end walls;

wherein said rim has a first position and a second position;

wherein said first position of said rim generally defines an oval opening;

wherein said second position of said rim generally defines a circular opening;

wherein said rim moves from said first position to said second position when said first compression force is applied to said first and second end walls; and wherein said second position of said rim is adapted to receive said tea bag in said container; and a plurality of vertical ribs positioned on said first and second side walls and extending to said bottom of said container.

13. An apparatus as recited in claim 12, further comprising:

a spout positioned along a first end wall of said first and second end walls; and a gripping region positioned on said first and second side walls.

14. An apparatus as recited in claim 12, further comprising:

one or more structures extending up from said bottom of said container;

wherein said tea bag retained in said container including being on a top portion of said one or more structures is compressed in response to said second compression force applied to said first and second side walls of said container.

15. A method for extracting tea liquid from a tea bag comprising:

providing a flexible container for receiving and compressing said tea bag, said flexible container having an inner container and an outer container, said outer container connected to said inner container to allow for passage of said tea liguid from said inner container to said outer container;

placing said tea bag in said inner container;

compressing said outer container to cause compression of said inner container to cause the tea liguid to be extracted in part form said tea bag, and in response to said compression said tea liquid flows from said tea bag, into said inner container, and further into said outer container; and wherein said tea liquid is capable of being poured from said outer container.

16. A method for extracting tea liquid from a tea bag comprising:

providing a flexible container for receiving and compressing said tea bag, said flexible container having first and second side walls, first and second end walls shorter than said first and second side wallls, and a continuous rim;

compressing said first and second end walls to move said rim from a generally oval cross section to a generally circular cross section;

placing said tea bag in said container when said rim has said generally circular cross section;

compressing said first and second side walls to cause compression of said tea bag, and in response to compression of said tea bag said tea liquid flows from said tea bag, and is retained in said container; and wherein said tea liquid is capable of being poured from said container and over said rim.

* * * * *